United States Patent [19]

Ståhl

[11] 4,181,475

[45] Jan. 1, 1980

[54] OIL HOUSING

[75] Inventor: Torvald F. Ståhl, Alvsjo, Sweden

[73] Assignee: ITT Industries, Inc., New York, N.Y.

[21] Appl. No.: 898,208

[22] Filed: Apr. 20, 1978

[30] Foreign Application Priority Data

Apr. 29, 1977 [SE] Sweden ..... 7704995

[51] Int. Cl.[2] ..... F04B 39/02; F04B 37/06

[52] U.S. Cl. ..... 417/372

[58] Field of Search ..... 417/366, 367, 369, 370, 417/372, 357

[56] References Cited

U.S. PATENT DOCUMENTS

| | | | |
|---|---|---|---|
| 2,517,233 | 8/1950 | Peters | 417/357 |
| 3,136,258 | 6/1964 | Bood | 417/367 |
| 3,220,350 | 11/1965 | White | 417/370 X |

*Primary Examiner*—Richard E. Gluck

*Attorney, Agent, or Firm*—James B. Raden; Donald J. Lenkszus

[57] ABSTRACT

An oil housing adapted for use between a motor and a pumping unit in a submersible pump is of generally cylindrical shape. A central chamber is adapted to receive a drive shaft and is divided into a bearing chamber and a seal chamber. An outer circumferential chamber is divided in a plurality of rooms. Some of the rooms are connected with the bearing chamber, other rooms are connected with the seal chamber, and the remaining rooms serve as air shafts for providing air flow between the motor and pumping unit. With this arrangement, different lubricating and cooling media may be employed for the motor bearings and seals.

2 Claims, 2 Drawing Figures

OIL HOUSING

BACKGROUND OF THE INVENTION

This invention pertains to an oilhousing arranged between a driving unit and a pumping unit of a submersible pump.

In order to prevent fluid from going into the driving unit, for instance an electric motor, the drive shaft is provided with a seal. Typically, two mechanical plane seals separated by an oil chamber are used. The oil serves to both lubricate and cool the seals. Up to now, the drive shaft has been supported by grease lubricated ball bearings or roller bearings. With the development of larger pumps, it has been determined that the bearings better withstand heavy loads and may have longer intervals between service with oil lubrication rather than grease lubrication. It is therefore desirable to provide an oil chamber for bearing lubrication.

In addition, larger pumps generate substantial amounts of heat and it becomes necessary to provide very good cooling of the motor windings. It is therefore desirable to permit air to circulate from the pump housing where it is cooled to the motor windings in the lower part of the motor housing.

SUMMARY OF THE INVENTION

In order to solve the problems of locating different oil chambers as well as cooling shafts in the space between the driving unit and the pumping unit, a lubrication and ventilation apparatus is provided for use intermediate and driving and pumping units. In accordance with the invention, such apparatus includes a cylindrical tank having a number of radially directed partitions which divide the tank in its axial direction into a number of chambers for containing different media for lubricating and cooling of bearings and seals respectively.

DESCRIPTION OF THE DRAWINGS

The invention may be better understood by referring to the description of a preferred embodiment when taken in conjunction with the drawings in which like reference numerals refer to like parts and in which.

DESCRIPTION OF THE PREFERRED EMBODIMENT

Figure 1:
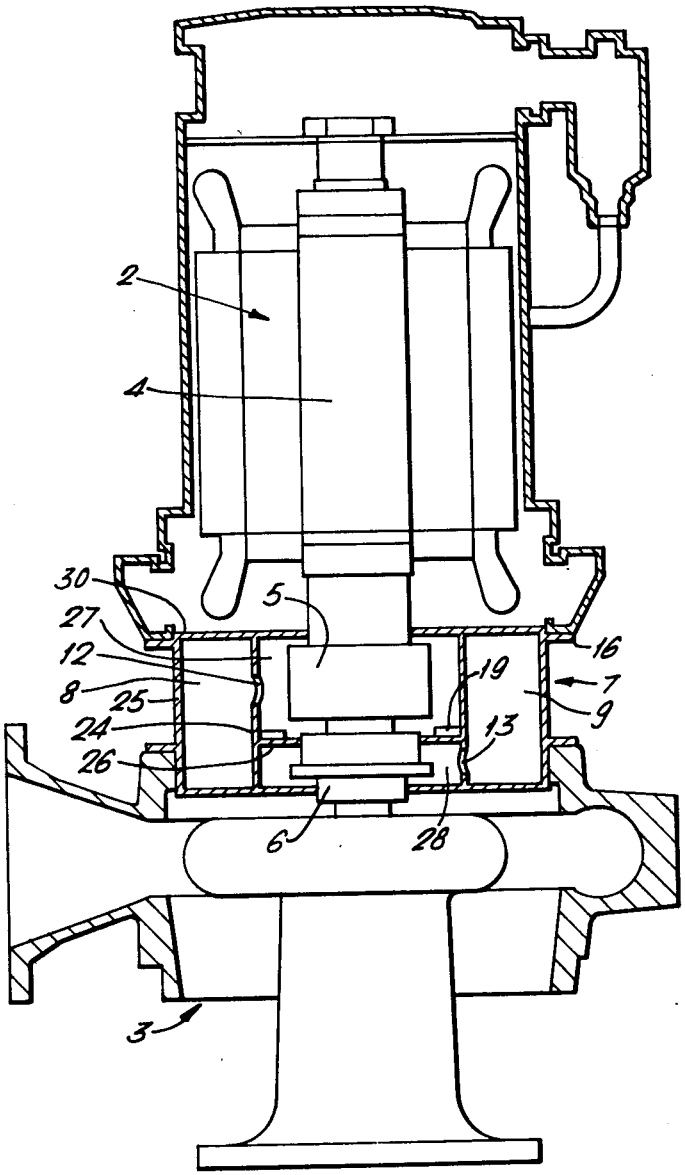
FIG. 1 illustrates in partial cross-section a pump comprising a driving unit, a pumping unit and an intermediate oil chamber in accordance with the invention.

The pump of FIG. 1 includes a driving unit or motor 2 having a drive shaft 4 connected to a pumping unit 3. A bearing assembly 5 supports the drive shaft 4. A seal assembly 6 is further provided.

Figure 2:
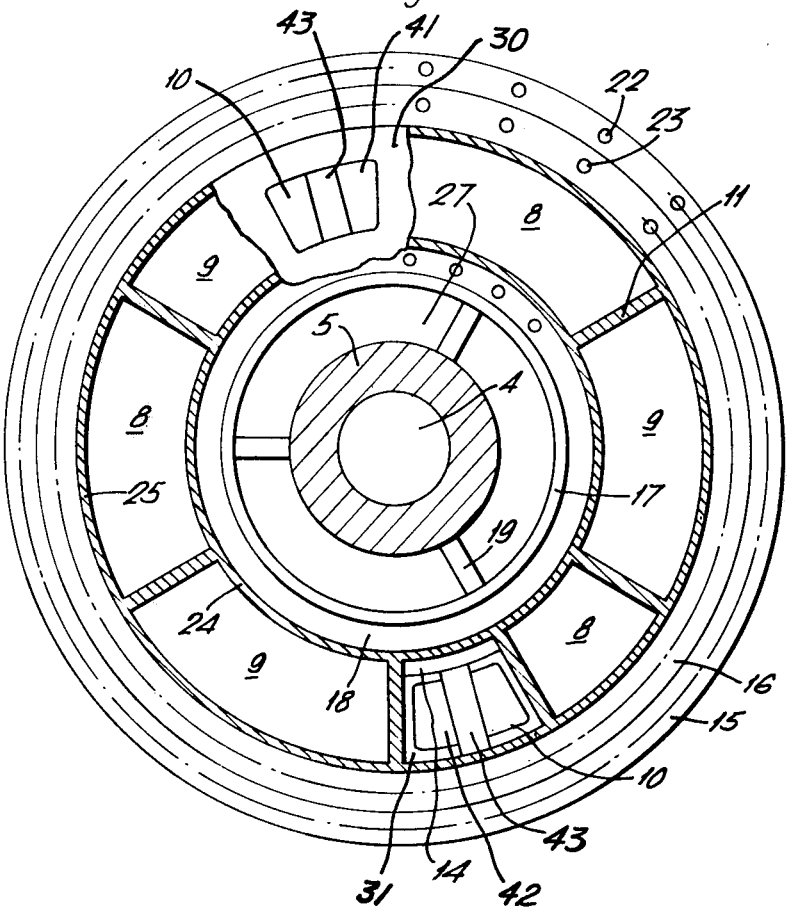
FIG. 2 illustrates a radial cross-section view of the oil housing of FIG. 1.

Intermediate the motor 2 and the pumping unit 3 is an oil housing 7 of generally cylindrical form having top and bottom walls 30 and 31 respectively and having a central axial recess for the drive shaft 4 and bearing assembly 5. As shown in both FIGS. 1 and 2, the oil housing 7 includes a flange 15 which is secured to the pumping unit 3 via conventional fastening arrangements such as by means of bolts which are passed through the bolt holes 22 which are circumferentially spaced along the flange 15 only some of which are shown. A similar flange 16 having bolt holes 23 only some of which are shown is connected to the motor by means of bolts or other fasteners.

A plurality of radial partitions 11 are arranged between the inner and outer walls 24 and 25, respectively, of the oil housing. The radial partitions 11 divide the outer chamber formed between the walls 24 and 25 into a plurality of rooms. Additionally, a partition wall 26 divides the inner chamber formed by the wall 24 into an upper bearing chamber 27 and a lower seal chamber 28. At the bottom of the upper bearing chamber 27, cam surfaces 19 are provided to agitate the oil for the bearings. A flange 18 connects the bearing assembly 5 to the oil housing and slot 17 is provided as a seat for an O-ring seal.

Each of the rooms 8 are connected to the bearing chamber 27 via apertures 12 and serve as reservoirs for bearing lubricating and cooling oil.

Each of the rooms 9 are connected to the sealing chamber 28 via apertures 13 and serve as reservoirs for seal lubricating and cooling oil.

The top and bottom walls 30 and 31 are apertured above the rooms 10 such that the rooms 10 are open to permit air to circulate between the lower portion of the driving unit 2 and the upper outer portion of the pumping unit 3. A portion of the top wall 30 above one room 10 is shown with an aperture 41 in FIG. 2. A portion of the bottom wall 31 having aperture 42 is shown below the other room 10. The flanges 14 in each of the rooms 10 serve to direct the air flow. The pumping unit is in turn cooled by the pumped medium.

Pipes 43 carry cooling water between the pumping unit 3 and the driving unit 2.

According to the invention, a compact oil housing is obtained which includes rooms for different lubricating and cooling media and rooms serving as air shafts which permit efficient cooling of the driving unit. The relatively short lengths of the structure permits a correspondingly short drive shaft to be employed.

What is claimed is:

1. An oil housing arranged between a driving unit and a pumping unit in a submersible pump, said oil housing comprising:
   - a cylindrical outer wall;
   - top and bottom walls each having a central aperture adapted to receive a drive shaft of said driving unit;
   - a cylindrical inner wall;
   - an outer chamber between said inner and outer walls and a central chamber;
   - a wall dividing said central chamber into a bearing chamber and a seal chamber;
   - a plurality of radially directed partitions between said inner and outer walls, said plurality of radially directed partitions dividing said outer chamber into first, second, and third pluralities of rooms;
   - means for permitting fluid communication between said first plurality of rooms and said bearing chamber; and
   - means for permitting fluid communication between said second plurality of rooms and said seal chamber.

2. An oil housing in accordance with claim 1, wherein said top and bottom walls each include a plurality of apertures, each of said apertures being in communication with a corresponding one of said third plurality of rooms whereby each of said third plurality of rooms serves as an air shaft.

* * * * *